United States Patent [19]

Anderson et al.

[11] Patent Number: 4,983,112

[45] Date of Patent: Jan. 29, 1991

[54] ARROW SLIDABLE BLADE UNIT

[76] Inventors: Robert L. Anderson, 841 Frankfort, Huntington Beach, Calif. 92648; Thomas E. Cacek, 3309 Arbor Rd., Lakewood, Calif. 90712

[21] Appl. No.: 475,197

[22] Filed: Feb. 5, 1990

[51] Int. Cl.[5] ..... F42B 6/08

[52] U.S. Cl. ..... 273/420

[58] Field of Search ..... 273/416, 419–422

[56] References Cited

U.S. PATENT DOCUMENTS

| | | | |
|---|---|---|---|
| 2,684,852 | 7/1954 | Romeka | 273/421 |
| 2,816,765 | 12/1957 | Stockfleth | 273/421 |
| 3,893,866 | 7/1975 | Hollingsworth | 273/418 |
| 4,234,191 | 11/1980 | Erlandson | 273/421 |
| 4,405,133 | 9/1983 | Cartwright, Jr. | 273/422 X |
| 4,463,953 | 8/1984 | Jordan | 273/418 |

*Primary Examiner*—Paul E. Shapiro

*Attorney, Agent, or Firm*—William W. Haefliger

[57] ABSTRACT

An arrow having an axially elongated shaft including a mandrel at the forward end of the shaft, a blade unit, comprising a generally axially extending tubular body, and blades on and projecting outwardly from the body, the body being telescopically slidable on the shaft; and structure on the body to releasably axially retain the body to the mandrel during airborne flight of the arrow, and to release the body for axial rearward sliding on the shaft in response to penetration of the mandrel into a target.

8 Claims, 2 Drawing Sheets

ARROW SLIDABLE BLADE UNIT

BACKGROUND OF THE INVENTION

This invention relates generally to the construction of arrows, and more particularly concerns the facilitation of arrow penetration into targets, and removal from targets.

Many arrows are typically constructed to have guidance blades or vanes at the rearward end, and cutting blades at the forward end of the arrow shafts. A problem then develops as regards arrow penetration into and removal from targets, namely, that the forward blades resist such penetration and withdrawal. One method of approaching this problem was to form the forward vanes of metal, with razor sharp edges; however, such arrows were then difficult to handle, and the problem of blade withdrawal from penetrated targets remained. Therefore, arrows were constructed to be disassembled at the target location, to enable their withdrawal; however this is a time-consuming activity.

SUMMARY OF THE INVENTION

It is a major object of the invention to provide an improved arrow structure, which obviates the above problem and difficulties, and also provides an arrow which is safer to handle. Basically, the arrow is constructed for use on an axially elongated shaft, including a mandrel (or other shaft forward portions) at the forward end of the shaft, and incorporates a blade unit that comprises:

(a) a generally axially extending tubular body, and blades on and projecting outwardly from the body, the body being telescopically slidable on the shaft, (b) and means on the body to releasably axially retain the body to the mandrel during airborne flight of the arrow, and to release the body for axial rearward sliding on the shaft in response to penetration of the mandrel into a target.

As will appear, the body typically has a tubular bore and is rotatable on the shaft during said rearward sliding. The body and blades may advantageously define a one-piece molded plastic unit, without dangerous target slicing sharp outer edges, but rather with blade outer edges that define target gripping serrations in a row, as will be seen.

It is another object of the invention to provide the above (b) means in the form of an annulus on the body sized to frictionally fit over an O-ring on the mandrel, and including said O-ring carried on the mandrel. When the plastic blade unit is displaced rearwardly on the O-ring, it is freely rotatable about the arrow shaft, as will also appear.

These and other objects and advantages of the invention, as well as the details of an illustrative embodiment, will be more fully understood from the following specification and drawings, in which:

DRAWING DESCRIPTION

DETAILED DESCRIPTION

Figure 1:
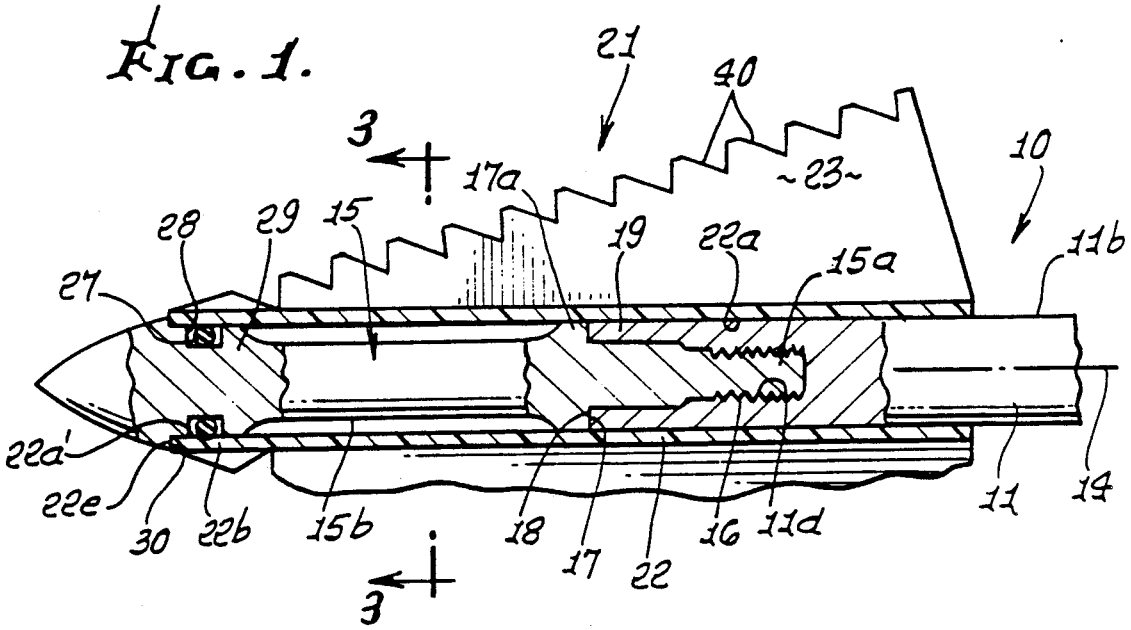
FIG. 1 is a section taken through forward extent of an arrow embodying the invention.
Figure 2:
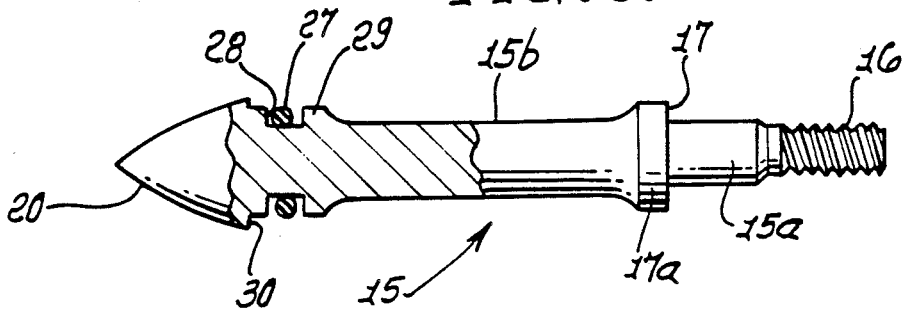
FIG. 2 is a view like FIG. 1, but showing only the forward mandrel portion of the arrow.
Figure 3:
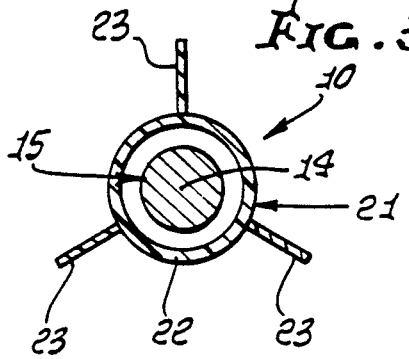
FIG. 3 is a section taken on lines 3—3 of FIG. 1.

In FIGS. 1–6, an arrow 10 includes an elongated shaft 11 which may for example be made of lightweight metal, such as aluminum. Primary guide blades or vanes 12 are attached to, or carried by the rearwardmost portion 11*a* of the shaft. They may consist of plastic (synthetic resin) material, and project radially outwardly from the shaft axis 14.

A mandrel 15 is located at the forward end of the shaft, and may have threaded connection to the shaft. See the external (pin) screw threads 16 on the mandrel rearward stem 15*a*, and the internal (box) screw threads 11*d* in the shaft. The mandrel has an annular step shoulder 17 to interfit the stop shoulder 18 at the forward end 19 of the shaft, upon make-up of the mandrel to the shaft. Shoulder 17 is on a rearward flange 17*a* on the mandrel. The forwardmost extent of the mandrel is tapered at 20, and forms a nose. The mandrell typically consists of a metal (steel, for example) of greater density than the shaft, to aid flight guidance. Also, removability of the mandrel from the shaft permits removal of a movable flight blade (or vane) unit 21.

Figure 6:
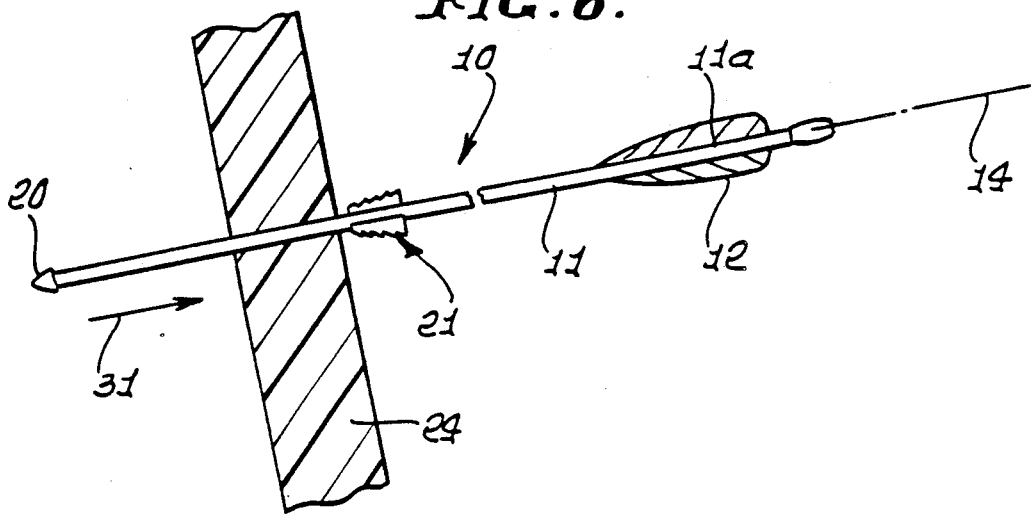
FIG. 6 is a view of the FIG. 5 arrow after it has penetrated a target.
Figure 7:
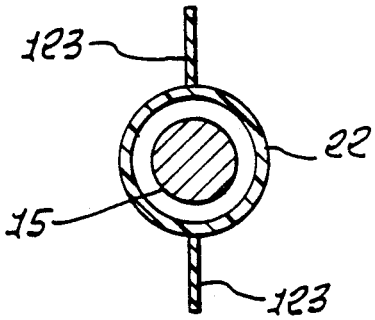
FIGS. 7 and 8 are views like FIG. 3, but showing modifications.
Figure 8:
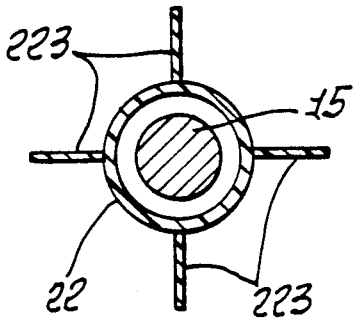

Unit 21 basically comprises a generally axially extending tubular body, and blades on and projecting outwardly from the body, the body being telescopically slidable on the shaft. In the example, the tubular body 22 has a bore 22*a*, which telescopically slidably interfits the mandrel flange 17*a*, as well as the shaft outer surface 11*b*. The unit 21 also includes blades (or vanes) 23 which are typically integral with body 22, to form a one-piece unit, typically consisting of molded plastic (synthetic resin). The slidability of the unit 21 on the shaft enables it to move, for example from a forwardmost position on the shaft and mandrel (see FIGS. 1 and 5), to and during arrow flight, (for flight guidance assistance), to a rearward position on the shaft, (as for example is seen in FIG. 6) in response to arrow impact with and penetration of a target 24. Such initial rearward slidability is enhanced by the annular reduction in diameter of the mandrel, at 15*b*, between flange 17*a* and a forward flange 29. Three blades 23 are shown, in FIG. 3, equidistantly spaced about axis 14; whereas FIGS. 7 and 8 show modifications incorporating two blades 123, and four blades 223, the construction of FIGS. 7 and 8 otherwise being the same as in FIGS. 1–4.

Further in accordance with the invention, means is provided on the body 22 to releasably axially retain the body to the mandrel during airborne flight of the arrow, and to release the body for axial rearward sliding on the shaft in response to penetration of the mandrel into a target. Such means also, typically, restrains the body 22 against said rotation while the body is releasably retained axially to the mandrel.

Figure 4:
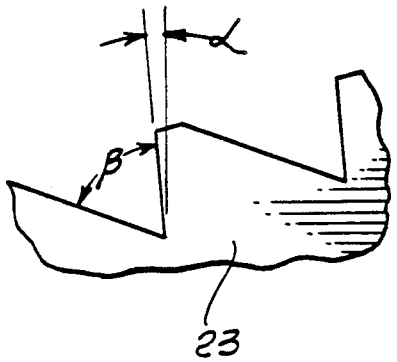
FIG. 4 is an enlarged view showing details of blade edge serration angularities.
Figure 5:
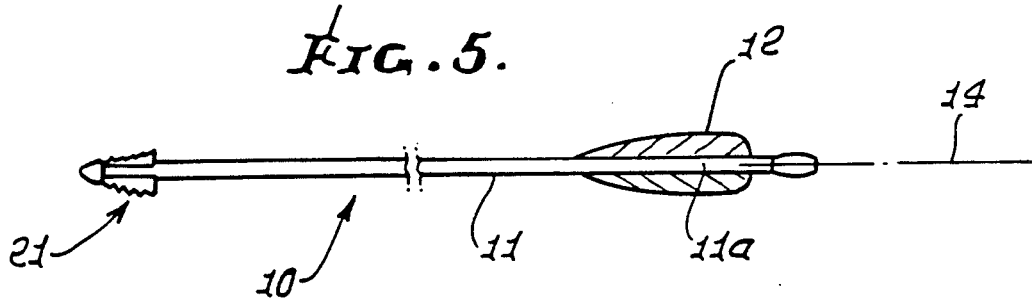
FIG. 5 is a view showing the complete arrow, of the invention, in flight.

In the example, the retaining and restraining means on the body 22 comprises an annulus (or annular forward portion 22*b*) on the body 22, having an inner surface or bore portion 22*a*′ rigid to frictionally receive an O-ring carried by the mandrel. See for example the elastomeric O-ring 27 received in annular groove 28 in the mandrel forward flange 29. The outer surface of the latter slidably interfits the bore 22*a* of unit 22. As seen in FIG. 1, the outermost surface of the O-ring frictionally interfits the bore portion 22*a'* to resist relative rearward telescopic sliding of the unit 22 on the shaft 11 during sharp acceleration of the arrow as it is released from the bow, and during arrow flight, as seen in FIG. 4. Rotation of the unit 22 about the shaft axis is then also resisted. Therefore, the unit 22 performs its arrow guidance inheritance, as in FIG. 5. Note also the positioning of unit 22 in FIG. 1, with its forward edge 22*e* engaging stop or positioning shoulder 30 on the mandrel.

When the arrow impacts a target 24, the mandrel and forward extent of the arrow penetrate the target (see FIG. 6 for example) without substantial resistance imposed by the unit 22, since the latter is pushed back on the arrow shaft by engagement with the target. Quick and easy release of the arrow from the target is then enabled, as by rearward pull-out in direction 31, since the unit 22 does not hinder such pull-out. If the unit 22 had penetrated deeply into or through the target, rearward pull-out would not be possible, and the mandrel would have to be detached, as by unscrewing, to enable arrow pull-out The parts 15, 22 and 11 would then be separated, and would have to be re-assembled. This time-consuming activity, greatly enhanced and aggravated when multiple arrows must be released from a target, is avoided and overcome by the invention. Once the arrow of the invention is pulled out from a target, it is only necessary to slide or move the unit 22 back to FIG. 1 position, which is quickly and easily accomplished, for arrow re-use.

Such push-back of the unit 22 on the shaft 11 upon impact with a target, is enhanced and assured by provision of blade or vane outer edge portions that are serrated for engagement with the target, thereby to resist deep penetration of the unit into the target. forwardly tapering row along the outer edge of each blade. These "teeth" engage the target and block slicing penetration into the target.

FIG. 4 shows one highly advantageous configuration of the serrations 40. They have edge taper angularity indicated at $\alpha$ and $\beta$, where:

$\alpha$ is about 5°

$\beta$ is about 65°

These angles are not to be regarded as restrictive on the invention.

As described, the unit 22 is rotatable on the shaft 11, when rearwardly displaced on the O-ring, to enable its free rearward displacement on the shaft as referred to.

We claim:

1. For use on an arrow having an axially elongated shaft including a mandrel at the forward end of the shaft, and in combination with said mandrel, a blade unit, comprising (a) a generally axially extending tubular body, and blades on and projecting outwardly from the body, the body being telescopically slidable on the shaft, and on the mandrel, (b) and means on the mandrel to releasably axially retain the body to the mandrel during airborne flight of the arrow, and to release the body for axial rearward sliding on the shaft in response to penetration of the mandrel into a target, said means comprising a forward flange defining an annular recess, and an O-ring in the recess and frictionally engaging a bore defined by the body, (c) the mandrel having a rearward flange supporting said bore, and the mandrel having an axially elongated peripheral annular recess defined between said flanges to eliminate frictional contact of the mandrel with said bore, between said flanges.

2. The combination of claim 1 wherein the body is tubular and has a tubular bore and is rotatable ion the shaft during said rearward sliding, said O-ring located proximate the forwardmost extent of said tubular body.

3. The combination of claim 2 wherein said means also restrains the body against said rotation while the body is releasably retained axially to the mandrel.

4. The combination of claim 1 wherein said body and blades define a one-piece unit.

5. The combination of claim 4 wherein said unit consists of molded plastic material.

6. The combination of claim 5 wherein said blades have outer edge portions which taper forwardly.

7. The combination of claim 6 wherein said blade outer edge portions are toothlike and blunted for engagement with the target.

8. The combination of claim 1 wherein the mandrel is metallic and has threaded attachment to the shaft, and including said shaft.

* * * * *